US008585183B2

(12) United States Patent
Nystrom et al.

(10) Patent No.: US 8,585,183 B2
(45) Date of Patent: Nov. 19, 2013

(54) HIGH DENSITY MULTILAYER INTERCONNECT FOR PRINT HEAD

(75) Inventors: Peter J. Nystrom, Webster, NY (US); Mark A. Cellura, Webster, NY (US); Gary Daniel Redding, Victor, NY (US)

(73) Assignee: Xerox Corporation, Norwalk, CT (US)

( * ) Notice: Subject to any disclaimer, the term of this patent is extended or adjusted under 35 U.S.C. 154(b) by 254 days.

(21) Appl. No.: 13/053,968

(22) Filed: Mar. 22, 2011

(65) Prior Publication Data

US 2012/0242756 A1 Sep. 27, 2012

(51) Int. Cl.
*B41J 2/045* (2006.01)

(52) U.S. Cl.
USPC ..... 347/68

(58) Field of Classification Search
None
See application file for complete search history.

(56) References Cited

U.S. PATENT DOCUMENTS

2008/0239022 A1* 10/2008 Andrews et al. ..... 347/71

OTHER PUBLICATIONS

Dolan et al., "Polymer Layer Removal on PZT Arrays a Using Plasma Etch", U.S. Appl. No. 13/011,409, filed Jan. 21, 2011.

* cited by examiner

*Primary Examiner* — Matthew Luu
*Assistant Examiner* — Erica Lin
(74) *Attorney, Agent, or Firm* — MH2 Technology Law Group LLP

(57) ABSTRACT

A method for forming an ink jet print head can include attaching a plurality of piezoelectric elements to a diaphragm, dispensing an interstitial layer over the diaphragm, and forming a plurality of patterned conductive traces on the interstitial layer to physically and electrically contact the plurality of piezoelectric elements. The plurality of patterned traces can be formed using, for example, photolithography, a lift-off process, laser ablation, etc. Electrical communication between the plurality of patterned conductive traces and the plurality of piezoelectric elements can be established through surface contact between the two structures, without the requirement of a separate conductor.

8 Claims, 7 Drawing Sheets

HIGH DENSITY MULTILAYER INTERCONNECT FOR PRINT HEAD

FIELD OF THE INVENTION

The present teachings relate to the field of ink jet printing devices and, more particularly, to high a density piezoelectric ink jet print head and methods of making a high density piezoelectric ink jet print head and a printer including a high density piezoelectric ink jet print head.

BACKGROUND OF THE INVENTION prop on demand ink jet technology is widely used in the printing industry. Printers using drop on demand ink jet technology can use either thermal ink jet technology or piezoelectric technology. Even though they are more expensive to manufacture than thermal ink jets, piezoelectric ink jets are generally favored as they can use a wider variety of inks and eliminate problems with kogation.

Piezoelectric ink jet print heads typically include a flexible diaphragm and a piezoelectric element (transducer) attached to the diaphragm. When a voltage is applied to the piezoelectric element, typically through electrical connection with an electrode electrically coupled to a voltage source, the piezoelectric element bends or deflects, causing the diaphragm to flex which expels a quantity of ink from a chamber through a nozzle. The flexing further draws ink into the chamber from a main ink reservoir through an opening to replace the expelled ink.

Increasing the printing resolution of an ink jet printer employing piezoelectric ink jet technology is a goal of design engineers. Increasing the jet density of the piezoelectric ink jet print head can increase printing resolution. One way to increase the jet density is to eliminate manifolds which are internal to a jet stack. With this design, it is preferable to have a single port through the back of the jet stack for each jet. The port functions as a pathway for the transfer of ink from the reservoir to each jet chamber. Because of the large number of jets in a high density print head, the large number of ports, one for each jet, must pass vertically through the diaphragm and between the piezoelectric elements.

Processes for forming a jet stack can include the formation of an interstitial layer between each piezoelectric element and, in some processes, over the top of each piezoelectric element. If the interstitial layer is dispensed over the top of the each piezoelectric element, it is removed to expose the conductive piezoelectric element. Next, a patterned standoff layer having openings therein can be applied to the interstitial layer, where the openings expose the top of each piezoelectric element. A quantity (i.e., a microdrop) of conductor such as conductive epoxy, conductive paste, or another conductive material is dispensed individually on the top of each piezoelectric element. Electrodes of a flexible printed circuit (i.e., a flex circuit) or a printed circuit board (PCB) are placed in contact with each microdrop to facilitate electrically communication between each piezoelectric element and the electrodes of the flex circuit or PCB. The standoff layer functions to contain the flow of the conductive microdrops to the desired locations on top of the piezoelectric elements, and also functions as an adhesive between the interstitial layer and the flex circuit or PCB.

Manufacturing a high density ink jet print head assembly having an external manifold has required new processing methods. As print resolution and piezoelectric element density of the print heads increase, the area available to provide electrical interconnects decreases. Routing of other functions within the head, such as ink feed structures, compete for this reduced space and place restrictions on the types of materials used. Methods for manufacturing a print head having electrical contacts which are easier to manufacture than prior structures, and the resulting print head, would be desirable.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

An embodiment of the present teachings can include a method for forming an ink jet print head which includes attaching a plurality of piezoelectric elements to a diaphragm, forming an interstitial layer between adjacent piezoelectric elements, wherein a surface of each piezoelectric element is exposed through the interstitial layer, forming a plurality of patterned traces on the interstitial layer to electrically contact the plurality of piezoelectric elements, wherein one trace is electrically coupled to each piezoelectric electrode, and forming a dielectric passivation layer over the plurality of traces.

Another embodiment of the present teachings can include a method for forming a printer which includes forming a jet stack. The method for forming the jet stack can include attaching a plurality of piezoelectric elements to a diaphragm, forming an interstitial layer between adjacent piezoelectric elements, wherein a surface of each piezoelectric element is exposed through the interstitial layer, forming a plurality of patterned traces on the interstitial layer, wherein each trace of the plurality of traces is electrically coupled to a respective piezoelectric element of the plurality of piezoelectric elements, and forming a dielectric passivation layer over the plurality of traces. The jet stack can be attached to a print head manifold, wherein a surface of the manifold and a surface of the jet stack forms an ink reservoir. The print head can be adapted to operate in accordance with digital instructions to create an image on a print medium.

In an embodiment, a print head for an ink jet printer can include a diaphragm having a plurality of openings therein, a plurality of piezoelectric elements attached to the diaphragm, an interstitial layer physically contacting the diaphragm and located between each adjacent piezoelectric element, and a plurality of conductive traces in surface contact with the interstitial layer, wherein each conductive trace of the plurality of traces is electrically coupled to a respective piezoelectric element of the plurality of piezoelectric elements, wherein electrical contact between each trace of the plurality of traces and the respective piezoelectric element of the plurality of piezoelectric elements is established through surface contact between each trace and the respective piezoelectric element.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

Figure 1:
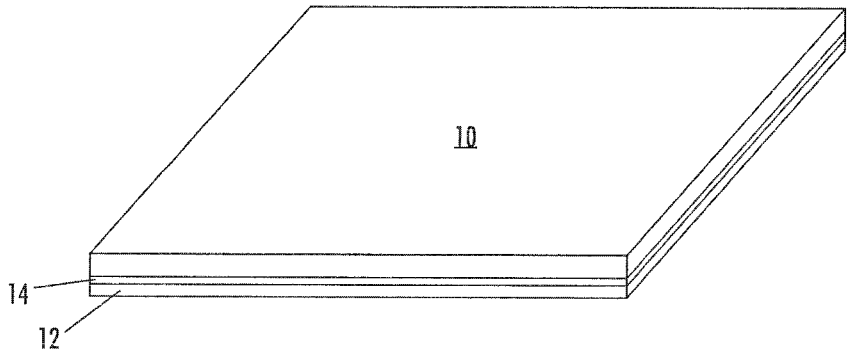
FIGS. 1 and 2 are perspective views of intermediate piezoelectric elements of an in-process device in accordance with an embodiment of the present teachings.

It should be noted that some details of the FIGS. have been simplified and are drawn to facilitate understanding of the inventive embodiments rather than to maintain strict structural accuracy, detail and scale.

DESCRIPTION OF THE EMBODIMENTS

Reference will now be made in detail to embodiments of the present teachings, an example of which is illustrated in the accompanying drawings. Wherever possible, the same reference numbers will be used throughout the drawings to refer to the same or like parts.

As used herein, the word "printer" encompasses any apparatus that performs a print outputting function for any purpose, such as a digital copier, bookmaking machine, facsimile machine, a multi-function machine, etc. The word "polymer" encompasses any one of a broad range of carbon-based compounds formed from long-chain molecules including thermoset polyimides, thermoplastics, resins, polycarbonates, epoxies, and related compounds known to the art.

With conventional processes for forming jet stacks such as those discussed above, the material cost of the conductor tends to be high, as a material with a high silver content is typically used to ensure good contact between the flex circuit electrodes and the piezoelectric elements. Additionally, the amount of conductor must be carefully controlled, because too little conductor can result in electrical opens and a non-functional piezoelectric element (transducer), while excessive conductor can result in overfill and electrical shorts between adjacent transducers. This can require rework, which is difficult due to the high density layout of the transducer array and the inability to access the piezoelectric elements due to the overlying flex circuit. Further, the accurate alignment and placement of the standoff layer is required so that the top of each piezoelectric element is exposed. These problems will accelerate with increasing density of the transducer array.

The formation and use of a print head is discussed in U.S. patent Ser. No. 13/011,409, titled "Polymer Layer Removal on PZT Arrays Using A Plasma Etch," filed Jan. 21, 2011, which is incorporated herein by reference in its entirety.

Embodiments of the present teachings can simplify the manufacture of a jet stack for a print head, which can be used as part of a printer. Further, the present teachings can improve electrical connection to piezoelectric elements, and result in simplified formation of a transducer array, particularly as transducer arrays continue to become more dense. The present teachings can include the use of a conductive layer, which can be patterned using optical photolithography, to make electrical contact to a transducer array such that a standoff layer and a flex circuit are not required. Thus the aforementioned problems associated with the standoff layer and connection of the flex circuit electrodes to the piezoelectric elements are avoided. Additionally, the process for forming the jet stack as discussed herein can be scaled with continued miniaturization of transducer arrays, as the use of an optical photolithographic process results in the accurate formation of very small features.

An embodiment of the present teachings can include the formation of a jet stack, a print head, and a printer including the print head. In the perspective view of FIG. 1, a piezoelectric element layer 10 is detachably bonded to a transfer carrier 12 with an adhesive 14. The piezoelectric element layer 10 can include, for example, a lead-zirconate-titanate layer, for example between about 25 μm to about 150 μm thick to function as an inner dielectric. The piezoelectric element layer 10 can be plated on both sides with nickel, for example, using an electroless plating process to provide conductive layers on each side of the dielectric PZT. The nickel-plated PZT functions essentially as a parallel plate capacitor which develops a difference in voltage potential across the inner PZT material. The carrier 12 can include a metal sheet, a plastic sheet, or another transfer carrier. The adhesive layer 14 which attaches the piezoelectric element layer 10 to the transfer carrier 12 can include a dicing tape, thermoplastic, or another adhesive. In another embodiment, the transfer carrier 12 can be a material such as a self-adhesive thermoplastic layer such that a separate adhesive layer 14 is not required.

Figure 2:
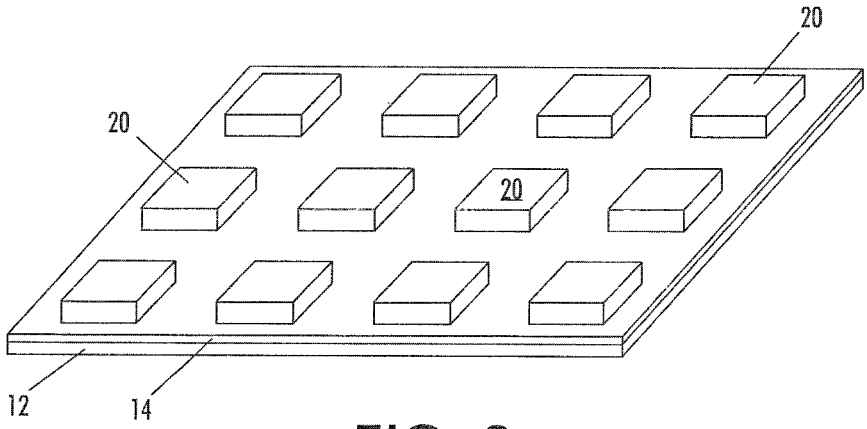

After forming the FIG. 1 structure, the piezoelectric element layer 10 is diced to form a plurality of individual piezoelectric elements 20 as depicted in FIG. 2. It will be appreciated that while FIG. 2 depicts 4×3 array of piezoelectric elements, a larger array can be formed. For example, current print heads can have a 344×20 array of piezoelectric elements 20. The dicing can be performed using mechanical techniques such as with a saw such as a wafer dicing saw, using a dry etching process, using a laser ablation process, etc. To ensure complete separation of each adjacent piezoelectric element 20, the dicing process can terminate after removing a portion of the adhesive 14 and stopping on the transfer carrier 12, or after dicing through the adhesive 14 and into the carrier 12.

Figure 3:
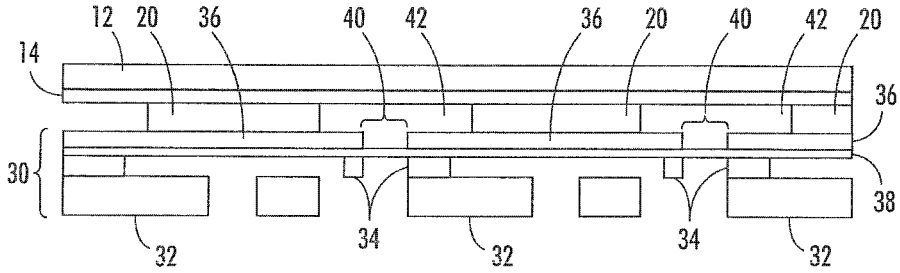
FIGS. 3-13 are cross sections depicting the formation of a jet stack for an ink jet print head.

After forming the individual piezoelectric elements 20, the FIG. 2 assembly can be attached to a jet stack subassembly 30 as depicted in the cross section of FIG. 3. The FIG. 3 cross section is magnified from the FIG. 2 structure for improved detail, and depicts cross sections of two complete and one partial piezoelectric elements 20. The jet stack subassembly 30 can be manufactured using known techniques. The jet stack subassembly 30 can include, for example, an inlet/outlet plate 32, a body plate 34, and a diaphragm 36 which is attached to the body plate 34 using an adhesive diaphragm attach material 38. The diaphragm 36 can include a plurality of openings 40 for the passage of ink in the completed device as described below. The FIG. 3 structure further includes a plurality of voids 42 which, at this point in the process, can be filed with ambient air. The diaphragm attach material 38 can be a solid sheet of material such as a single sheet polymer so that the openings 40 through the diaphragm 36 are covered.

In an embodiment, the FIG. 2 structure can be attached to the jet stack subassembly 30 using an adhesive between the diaphragm 36 and the piezoelectric elements 20. For example, a measured quantity of adhesive (not individually depicted) can be dispensed, screen printed, rolled, etc. onto either the upper surface of the piezoelectric elements 20, onto the diaphragm 36, or both. In an embodiment, a single drop of adhesive can be placed onto the diaphragm for each individual piezoelectric element 20. After applying the adhesive, the jet stack subassembly 30 and the piezoelectric elements 20 are aligned with each other, then the piezoelectric elements 20 are mechanically connected to the diaphragm 36 with the adhesive. The adhesive is cured by techniques appropriate for the adhesive to result in the FIG. 3 structure.

Subsequently, the transfer carrier 12 and the adhesive 14 are removed from the FIG. 3 structure to result in the structure of FIG. 4.

Figure 4:
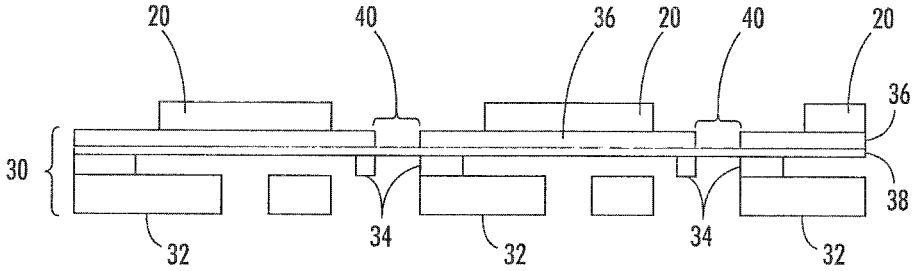
Figure 5:
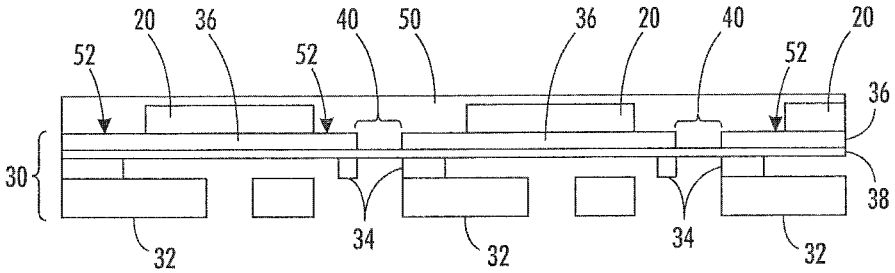

Next, an interstitial layer is dispensed over the FIG. 4 structure, then cured to provide an interstitial layer 50. The interstitial layer can be a polymer, for example a combination of Epon™ 828 epoxy resin (100 parts by weight) available from Miller-Stephenson Chemical Co. of Danbury, Conn. and Epikure™ 3277 curing agent (49 parts by weight) available from Hexion Specialty Chemicals of Columbus, Ohio. The uncured interstitial layer can be dispensed in a quantity sufficient to cover exposed portions of an upper surface 52 of the diaphragm 36 and to encapsulate the piezoelectric elements 20 subsequent to curing as depicted in FIG. 5. The interstitial layer can further fill the openings 40 within the diaphragm 36 as depicted. The diaphragm attach material 38 which covers openings 40 in the diaphragm 36 prevents the uncured interstitial layer from passing through the openings 40. The interstitial layer 50 can be planarized either before or after curing. Planarization can be performed, for example, by material self-leveling or techniques including mechanical wiping and molding under pressure.

Figure 6:
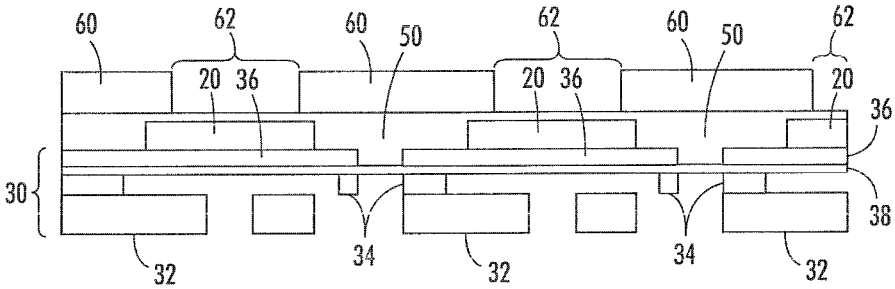

Next, the interstitial layer 50 is removed from the upper surface of the piezoelectric elements 20. In an embodiment, a patterned mask 60 such as a patterned photoresist mask can be formed with openings 62 using known photolithographic techniques as depicted in FIG. 6. The openings 62 expose a portion of the interstitial layer 50 which covers each piezoelectric element 20, and further expose a portion of each piezoelectric element 20 as depicted. In this embodiment, the exposed interstitial layer 50 is removed from the top of each piezoelectric element 20 using a wet or dry etch. In another embodiment, the interstitial layer 50 can be removed to expose each piezoelectric element 20 using laser ablation, omitting the requirement for a patterned mask 60.

Figure 7:
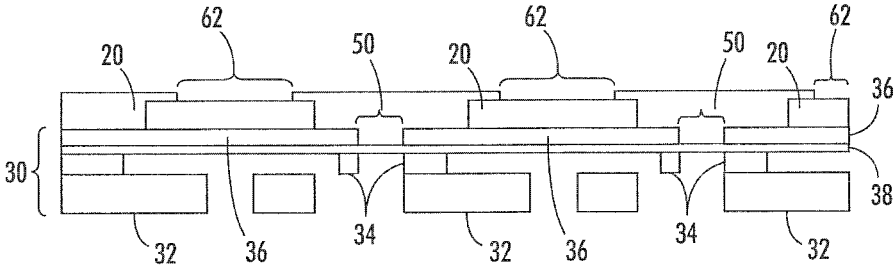
Figure 8:
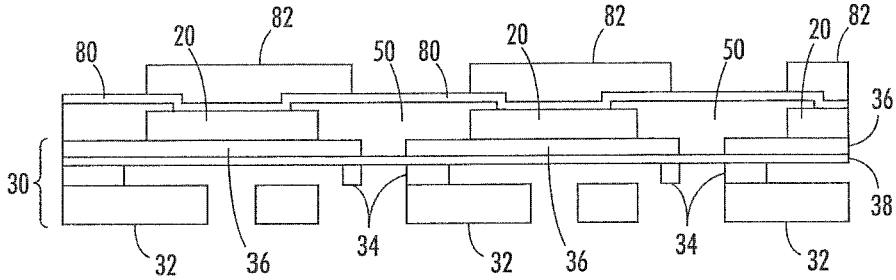

After removing the interstitial layer 50 to expose the top surface of each piezoelectric element 20, the patterned mask 60, if used, is removed to result in the structure of FIG. 7. Next, a blanket conductive trace layer 80 can be formed over the FIG. 7 structure as depicted in FIG. 8. The trace layer 80 can be a conformal layer as depicted, or can be a planar layer, depending on the desired final design structure. The trace layer 80 can be formed using any sufficient process, for example chemical vapor deposition, physical vapor deposition, metal plating, and sputtering. In various embodiments, the trace layer 80 can be formed from copper, aluminum, gold, an alloy, and combinations of these. In an embodiment, the trace layer 80 can be formed to an average thickness of between about 0.5 micrometers (μm) and about 10 μm, or between about 0.8 μm and about 1.1 μm. Other thicknesses may be sufficient, depending on the design of the device being manufactured. The blanket trace layer 80 is in surface contact with the dielectric interstitial layer 50, and in surface contact with each conductive piezoelectric element 20.

After forming the blanket conductive trace layer 80, a patterned mask 82 having openings therein which expose the trace layer 80 is formed over the surface of the trace layer 80. The patterned mask 82 can be a patterned photosensitive layer, for example photoresist, formed using conventional photolithographic techniques. The design of the patterned mask 82 will depend on the desired pattern of trace routings which will be provided by the trace layer 80 subsequent to etching.

Subsequently, a wet or dry etch is performed to remove exposed portions of the conductive layer 80. The interstitial layer 50 can be used as an etch stop layer. After etching, the patterned mask 82 is removed to result in a structure similar to that depicted in FIG. 9. After etching, each piezoelectric element 20 is electrically coupled to an individual conductive trace 80 formed from the trace layer. Each trace 80 is formed on a piezoelectric element 20. Electrical contact between the plurality of traces 80 and the plurality of piezoelectric elements 20 is established through physical contact (surface contact) between each trace 80 and one of the piezoelectric elements 20. Each trace 80, during use of the print head, will supply an individual voltage connection to each piezoelectric element 20 such that each piezoelectric element is individually addressable.

While this embodiment describes patterning the conductive trace layer using photolithography, it will be understood that other patterning processes, such as a lift off process or a laser ablation process, can also be used to form a patterned trace layer.

Figure 9:
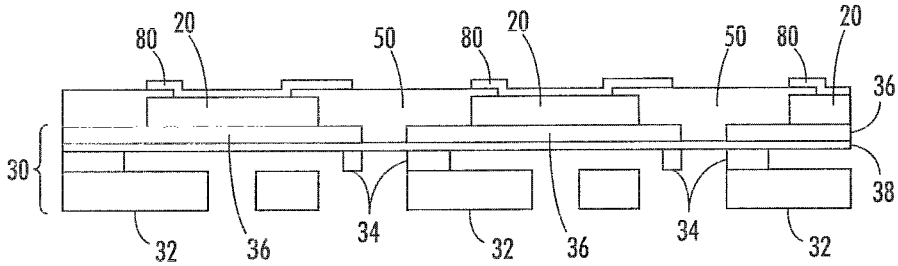
Figure 10:
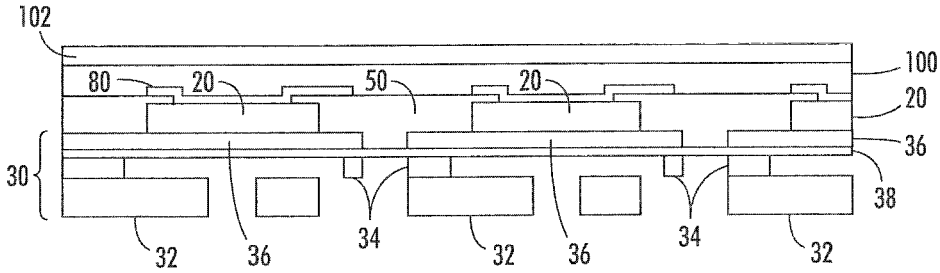

Next, a dielectric passivation layer 100 can be formed over the surface of the FIG. 9 structure as depicted in FIG. 10. The passivation layer 100 protects the conductive traces 80, and forms a planar layer as a base for additional processing. The passivation layer 100 can include a material similar to the polymer which forms interstitial layer 50, or another dielectric layer. The additional processing is optional and can include various conductive and/or dielectric layers, either patterned or unpatterned, which are represented by the additional layer 102 and depends on the design of the device being manufactured. Additional processing can include layers needed to route ink and/or provide lamination for heater and manifold functions.

Figure 11:
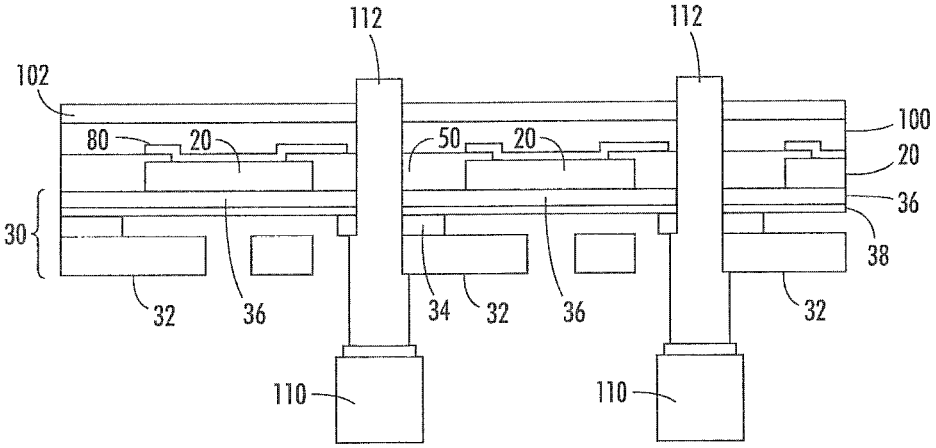
Figure 12:
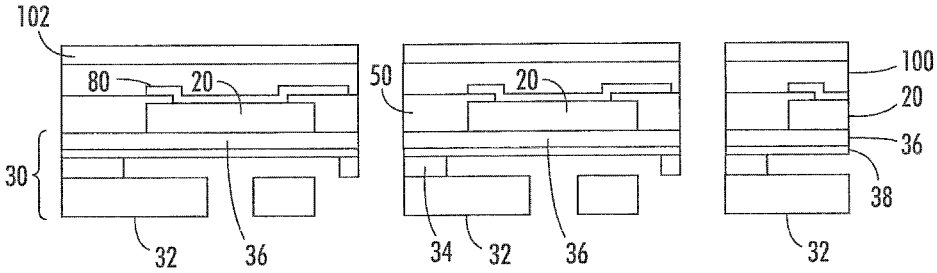

Next, the openings 40 through the diaphragm 36 can be cleared to allow passage of ink through the diaphragm 36. Clearing the openings 40 includes removing a portion of the adhesive diaphragm attach material 38, the interstitial layer 50, the passivation layer 100, and additional layers 102 (if present). Additionally, a portion of one or more traces 80 can be removed, as long as it does not result in undesirable electrical characteristics such as an electrical open. In various embodiments, chemical or mechanical removal techniques can be used. In an embodiment, a self-aligned removal process can include the use of a laser 110 outputting a laser beam 112 as depicted in FIG. 11, particularly where the inlet/outlet plate 32, the body plate 34, and the diaphragm 36 are formed from metal. The inlet/outlet plate 32, the body plate 34 and optionally, depending on the design, the diaphragm 36 can mask the laser beam 112 for a self-aligned laser ablation process. In this embodiment, a laser such as a $CO_2$ laser, an excimer laser, a solid state laser, a copper vapor laser, and a fiber laser can be used. A $CO_2$ laser and an excimer laser can typically ablate polymers including epoxies. A $CO_2$ laser can have a low operating cost and a high manufacturing throughput. While two lasers 110 are depicted in FIG. 11, a single laser beam can open each hole in sequence using one or more laser pulses. In another embodiment, two or more openings can be made in a single operation. For example, a mask can be applied to the surface then a single wide single laser beam could open two or more openings, or all of the openings, using one or more pulses from a single wide laser beam. A $CO_2$ laser beam that can over-fill the mask provided by the inlet/outlet plate 32, the body plate 34, and possibly the diaphragm 36 could sequentially illuminate each opening 40 to form the extended openings through the adhesive diaphragm attach material 38, the interstitial layer 50, the passivation layer 100, and additional layers 102 as depicted in FIG. 11 to result in the FIG. 12 structure.

Figure 13:
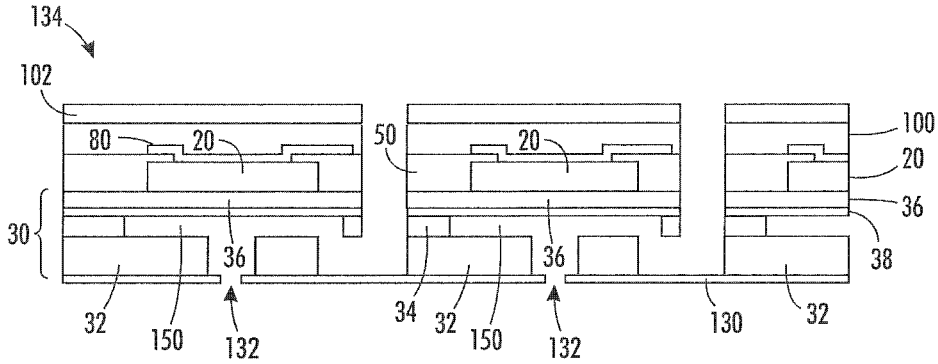

Subsequently, an aperture plate 130 can be attached to the inlet/outlet plate 32 with an adhesive (not individually depicted) as depicted in FIG. 13. The aperture plate 130 includes nozzles 132 through which ink is expelled during printing. Once the aperture plate 132 is attached, the jet stack 134 is complete.

Figure 14:
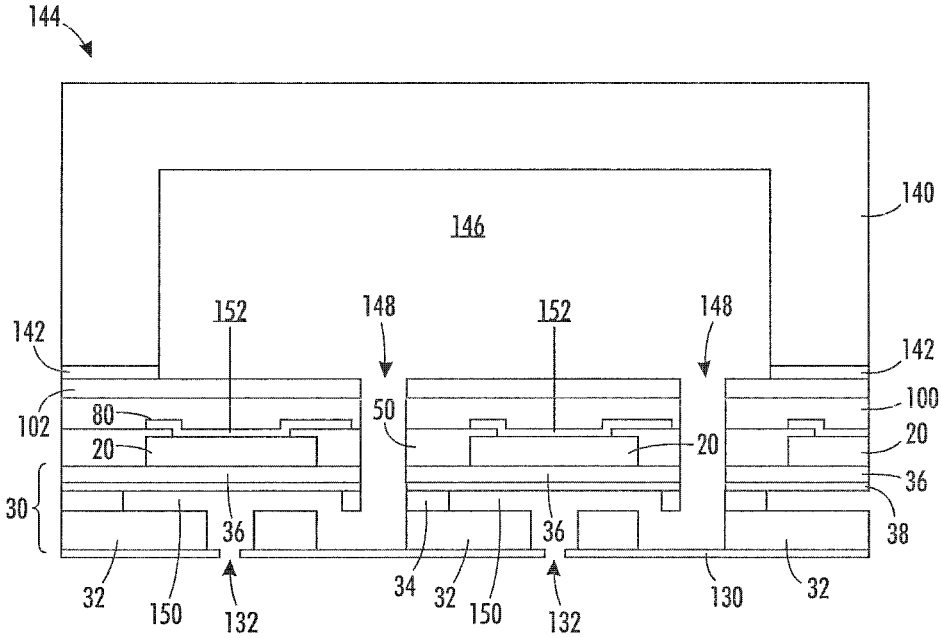
FIG. 14 is a cross section of a print head including the jet stack of FIG. 13.

Subsequently, a manifold 140 can be bonded to the upper surface of the jet stack 134, for example using a fluid-tight sealed connection 142 such as an adhesive to result in an ink jet print head 144 as depicted in FIG. 14. The ink jet print head 144 can include an ink reservoir 146 formed by a surface of the manifold 140 and the upper surface of the jet stack 134 for storing a volume of ink. Ink from the reservoir 146 is delivered through ports 148 in the jet stack 134. It will be understood that FIG. 14 is a simplified view. An actual print head may include various structures and differences not depicted in FIG. 14, for example additional structures to the left and right, which have not been depicted for simplicity of explanation. While FIG. 14 depicts two ports 148, a typical jet stack can have, for example, a 344×20 array of ports.

In use, the reservoir 146 in the manifold 140 of the print head 144 includes a volume of ink. An initial priming of the print head can be employed to cause ink to flow from the reservoir 146, through the ports 148 in the jet stack 134, and into chambers 150 in the jet stack 134. Responsive to a voltage 152 placed on each trace 80, each PZT piezoelectric element 20 deflects at an appropriate time in response to a digital signal. The deflection of the piezoelectric element 20 causes the diaphragm 36 to flex which creates a pressure pulse within the chamber 150 causing a drop of ink to be expelled from the nozzle 132.

The methods and structure described above thereby form a jet stack 134 for an ink jet printer. In an embodiment, the jet stack 134 can be used as part of an ink jet print head 144 as depicted in FIG. 14.

Figure 15:
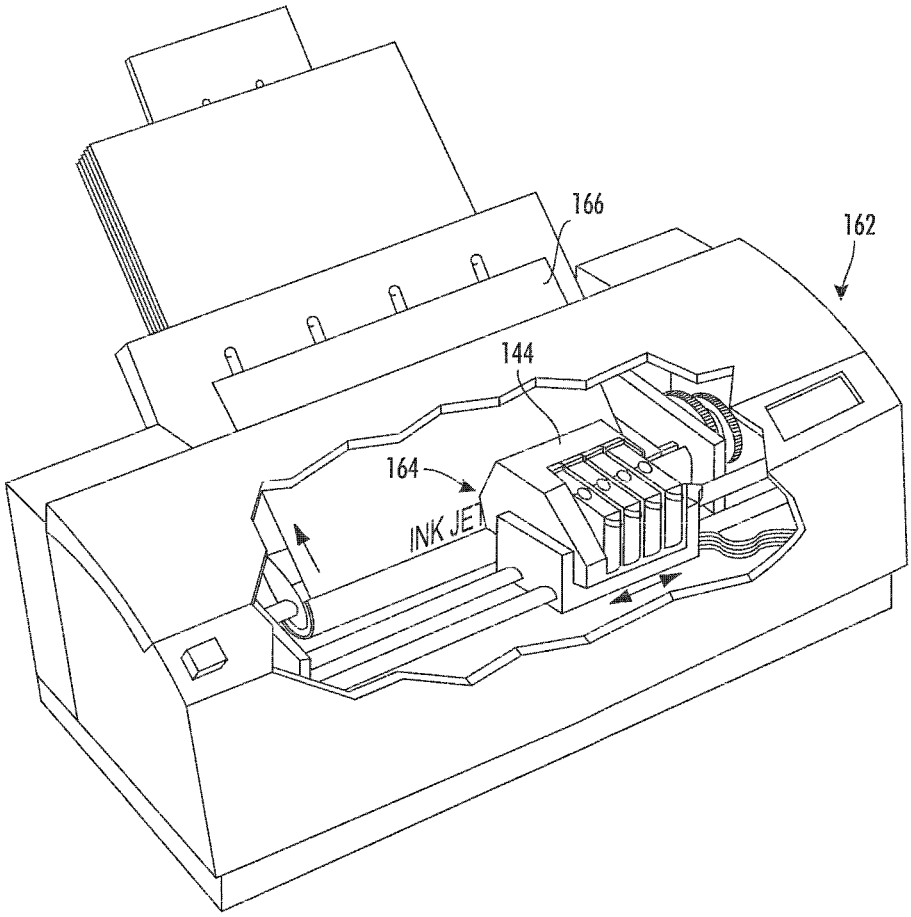
FIG. 15 is a printing device including a print head according to an embodiment of the present teachings.

FIG. 15 depicts a printer 162 including one or more print heads 144 and ink 164 being ejected from one or more nozzles 132 in accordance with an embodiment of the present teachings. Each print head 144 is adapted to operate in accordance with digital instructions to create a desired image on a print medium 166 such as a paper sheet, plastic, etc. Each print head 144 may move back and forth relative to the print medium 166 in a scanning motion to generate the printed image swath by swath. Alternately, the print head 144 may be held fixed and the print medium 166 moved relative to it, creating an image as wide as the print head 144 in a single pass. Additionally, printing can include using the print head 144 to form an ink pattern 164 on an intermediate heated structure (not individually depicted for simplicity) such as a drum, and using the drum to transfer (transfix) the image onto the print medium 166. The print head 144 can be narrower than, or as wide as, the print medium 166.

The embodiment described above can thus provide a jet stack for an ink jet print head which can be used in a printer. The method for forming the jet stack, and the completed jet stack, does not require the use of a standoff layer to contain the flow of conductor which electrically couples an electrode or other conductive element to a piezoelectric element. Additionally, the method does not require the removal of an interstitial layer from the top of each piezoelectric element. In this embodiment, the patterned blanket trace layer 80, which is used to supply a voltage 152 to each piezoelectric element 20 responsive to a digital signal, can be patterned using optical photolithography. This results in a jet stack and print head which requires no standoff layer to contain a liquid or paste adhesive which electrically couples a flex circuit electrode to each piezoelectric element. Similarly, the jet stack and print head also requires no flex circuit to route a voltage to each piezoelectric element. Because no flex circuit which connects to the piezoelectric elements is needed, any required rework is simplified as access to the piezoelectric elements 20 and traces 80 is simplified.

Various routings and interconnects can be electrically coupled to the traces 80 and to controlling printhead electronics to provide a voltage to the piezoelectric elements. These routings and interconnects can be provided by additional dielectric and metal layers in order to solve complex routing as necessary, and may be supplied by a PCB or flex circuit. Further, spacing constraints can be relaxed if input/output redistribution is more efficient. The traces can allow driver chips or application specific integrated circuits to be mounted to the top surface of the jet stack 134, for example using flip chip bonding, to electrically couple to the piezoelectric elements through traces 80. Any remaining flex circuit connection can be limited to various voltage supplies, as well as clock, data, and control signals, while omitting direct connection to the piezoelectric elements. The present teachings can reduce the number of components, materials, and assembly stages compared to some prior processes. Additionally, the present teachings can result in increased resolution of conductive paths or traces, thereby allowing for higher transducer densities and improved cleanliness by eliminating laser cut parts. Yields can improve through elimination of many current failure modes such as short circuits, for example channel to channel shorts and channel to ground shorts. By simplifying the material set, compatibility with ink and other environmental materials typical of ink jet print heads can be improved. This type of interconnect technology can further be applied to other high density array structures, such as image input scanners and other sensors or transducers.

Note that while the exemplary method is illustrated and described as a series of acts or events, it will be appreciated that the present invention is not limited by the illustrated ordering of such acts or events. For example, some acts may occur in different orders and/or concurrently with other acts or events apart from those illustrated and/or described herein, in accordance with the present teachings. In addition, not all illustrated steps may be required to implement a methodology in accordance with the present teachings. Other embodiments will become apparent to one of ordinary skill in the art from reference to the description and FIGS. herein.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. In addition, while a particular feature of the disclosure may have been described with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a wafer or substrate, regardless of the orientation of the wafer or substrate. The term "horizontal" or "lateral" as used in this application is defined as a plane parallel to the conventional plane or working surface of a wafer or substrate, regardless of the orientation of the wafer or substrate. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the wafer or substrate, regardless of the orientation of the wafer or substrate.

The invention claimed is:

1. A method for forming an ink jet print head, comprising:

attaching a plurality of piezoelectric elements to a diaphragm;

forming an interstitial layer directly between adjacent piezoelectric elements, wherein a surface of each piezoelectric element is exposed through the interstitial layer;

forming a plurality of patterned traces on the interstitial layer such that, during the formation of the plurality of traces, the plurality of traces physically contact the interstitial layer and physically and electrically contact the plurality of piezoelectric elements, wherein each trace is electrically coupled to one of the plurality of piezoelectric elements through physical contact with the one of the piezoelectric elements; and forming a dielectric passivation layer over the plurality of traces.

2. The method of claim 1, further comprising:

forming a blanket trace layer on the interstitial layer to electrically contact the plurality of piezoelectric elements;

patterning a photosensitive layer over the blanket trace layer; and etching of the blanket trace layer using the patterned photosensitive layer as a pattern to form the plurality of traces.

3. The method of claim 1, further comprising:

forming a blanket trace layer; and performing a laser patterning process to ablate a portion of the blanket trace layer to form the plurality of traces.

4. The method of claim 1, further comprising:

covering a plurality of openings within the diaphragm with a diaphragm attach material;

attaching a body plate to the diaphragm with the diaphragm attach material; and during the formation of the interstitial layer, contacting the diaphragm with the interstitial layer, wherein the diaphragm attach material prevents the interstitial layer from passing through the plurality of openings in the diaphragm.

5. The method of cm further comprising:

using a laser beam to ablate a portion of the diaphragm attach material, the interstitial layer, and the passivation layer to clear the plurality of openings within the diaphragm to allow the passage of ink therethrough.

6. The method of claim 5, further comprising:

using at least one of the diaphragm, the body plate, or an inlet/outlet plate attached to the body plate to mask the laser beam during the ablation which clears the plurality of openings in the diaphragm.

7. The method, of claim further comprising:

establishing electrical contact between the plurality of traces and the plurality of piezoelectric elements through surface contact between the plurality of traces and the plurality of piezoelectric elements.

8. The method of claim 1, further comprising:

using the interstitial layer as an etch stop during the etching of the blanket trace layer to form the plurality of traces.

* * * * *